US009211940B2

(12) United States Patent
Richer De Forges

(10) Patent No.: US 9,211,940 B2
(45) Date of Patent: Dec. 15, 2015

(54) KNUCKLE DEFLECTOR FOR MARINE SEISMIC SURVEY SYSTEM

(71) Applicant: CGG SERVICES SA, Massy Cedex (FR)

(72) Inventor: Hervé Richer De Forges, Massy (FR)

(73) Assignee: CGG SERVICES SA, Massy (FR)

( * ) Notice: Subject to any disclaimer, the term of this patent is extended or adjusted under 35 U.S.C. 154(b) by 163 days.

(21) Appl. No.: 13/972,156

(22) Filed: Aug. 21, 2013

(65) Prior Publication Data

US 2014/0109818 A1 Apr. 24, 2014

(30) Foreign Application Priority Data

Oct. 24, 2012 (FR) ..... 12 60132

(51) Int. Cl.
*B63B 21/66* (2006.01)

(52) U.S. Cl.
CPC ..... *B63B 21/66* (2013.01); *Y10T 29/49826* (2015.01)

(58) Field of Classification Search
CPC ..... B63B 21/66; G01V 1/3817
See application file for complete search history.

(56) References Cited

U.S. PATENT DOCUMENTS

| | | | | |
|---|---|---|---|---|
| 2,589,312 | A | 3/1952 | Wilcoxon | |
| 2,960,960 | A | 11/1960 | Fehlner | |
| 3,137,264 | A * | 6/1964 | Brainard, II et al. | 114/244 |
| 4,173,195 | A * | 11/1979 | Gongwer | 114/244 |
| 4,693,487 | A | 9/1987 | Cooper | |
| 4,695,012 | A * | 9/1987 | Lindenbaum | 244/26 |
| 5,443,027 | A | 8/1995 | Owsley et al. | |
| 7,933,163 | B2 | 4/2011 | Fossum et al. | |
| 2008/0022913 | A1 | 1/2008 | Toennessen et al. | |
| 2010/0149910 | A1 * | 6/2010 | Martin | 367/17 |

OTHER PUBLICATIONS

European Search Report dated Jan. 23, 2014, in related EP Application No. 13190035.
French Preliminary Search Report dated Jul. 15, 2013 in related application FR 1260132.

* cited by examiner

*Primary Examiner* — Edwin Swinehart
(74) *Attorney, Agent, or Firm* — Patent Portfolio Builders PLLC

(57) ABSTRACT

Deflectors configured to be attached to cables towed behind a vessel for performing a marine survey and associated methods are provided. A deflector has a body including a wing portion and a knuckle portion. The wing portion has substantially flat wings extending away from a position where the body is attached to the cable. The knuckle portion is configured to attach the wing portion to the cable so that the wing portion remains able to rotate about three rectangular axes while being towed underwater.

18 Claims, 6 Drawing Sheets

KNUCKLE DEFLECTOR FOR MARINE SEISMIC SURVEY SYSTEM

BACKGROUND

1. Technical Field

Embodiments of the subject matter disclosed herein generally relate to devices and systems used for marine exploration and, more particularly, to deflectors that are attached to cables of marine seismic survey systems via a knuckle portion, with the deflectors providing lift forces to enhance stability of the survey geometry.

2. Discussion of the Background

During the recent past, interest in developing new oil and gas production fields has dramatically increased. With availability of land-based production fields being limited, offshore drilling locations that appear to hold vast amounts of fossil fuel have developed. Since offshore drilling is an expensive process those engaged in it invest substantially in geophysical surveys to determine promising drilling locations based on more accurate information in order to avoid dry wells.

In geophysical surveys, waves (such as, but not limited to, seismic waves) are directed toward the seabed. Information (e.g., travel time and energy) about waves reflected back to receivers located close to the water's surface is used to learn about the structure and nature of layers underneath the seabed (e.g., to generate images of the substructure). In order to obtain high-resolution images, multiple techniques and devices are used to maintain the data acquisition geometry (e.g., relative positions of the wave sources and the receivers) while performing the survey.

As illustrated in FIG. 1, in a marine seismic survey system 100, a vessel 110 usually tows a wave source 120, and streamers 130 (only one shown in FIG. 1) connected to the vessel 110 via lead-in cables 125. The streamers 130 are configured to carry wave detectors (i.e., receivers), such as 140*a*, 140*b*, 140*c*, 140*d* and 140*e*.

Waves generated by the source 120 penetrate the seafloor 150 and layers 155, 165 and 175 underneath. The waves may propagate at different speeds through these layers 155, 165 and 175, because the layers have different properties (e.g., composition and density). Reflection and refraction may occur when waves cross interfaces between layers through which they pass at different speeds. Waves partially reflected at a first interface 160 between layer 155 and layer 165, at a second interface 170 between layer 165 and layer 175, etc., are detected by receivers 140*a*-140*e* located along the streamers 130.

Currently used marine survey systems include plural streamers. It is desirable to deploy and maintain the streamers and the source(s) at predetermined depths and relative lateral offsets, according to the intended data acquisition geometry. One such device used to arrange and maintain the components of the marine survey systems according to the intended data acquisition geometry is a deflector 135. In FIG. 1, the deflector 135 is attached to the lead-in cables 125.

Deflectors of different sizes may be deployed at different positions along a cable to provide a lift force while towed underwater. Plural deflectors may be attached to the same cable, or one deflector may be connected via cables or ropes so as to affect plural streamers.

As illustrated in FIG. 2, a conventional method of attaching a deflector 200 (which has a rectangular wing body 210) to a lead-in cable 225 located between the towing vessel (not shown) and the streamer 230, uses more or less complex rigging 227 connected usually to one side of the wing body 210. A disadvantage for this conventional method is that the deflector's capacity to recover and return to its intended posture (e.g., the desired attack angle) following an accidental or intentional departure thereof is low.

Another conventional method of attaching a deflector to a cable uses a pivot link. A disadvantage of this conventional method is the high risk of the deflector rotating around the pivot and towing the cable down rather than laterally when an occasional pitch movement (which is coupled with the roll) occurs.

Thus, it is desirable to have a deflector with a more flexible connection to the lead-in cable, which deflector overcomes problems associated with the conventional deflectors.

SUMMARY

Some of the embodiments provide a deflector for marine seismic survey systems configured to better maintain the deflector's lift (lateral) direction relative to the towing direction.

According to one exemplary embodiment, there is a deflector configured to be attached to a cable towed by a vessel. The deflector has a body configured to provide a lift force to the cable and includes a wing portion and a knuckle portion. The wing portion includes substantially flat wings extending away from a position where the body is attached to the cable. The knuckle portion is configured to attach the wing portion to the cable so that the wing portion remains able to rotate about three rectangular axes while being towed underwater.

According to another exemplary embodiment, there is a marine seismic survey system including a cable towed by a vessel, and a deflector attached to the cable. The deflector has a body configured to provide a lift force to the cable. The body includes (A) a wing portion having substantially flat wings extending away from a position where the body is attached to the cable, and (B) a knuckle portion configured to attach the wing portion to the cable so that the wing portion remains able to rotate about three rectangular axes while being towed underwater.

According to another exemplary embodiment, there is a method of placing a deflector on a cable towed by a vessel of a marine seismic survey system. The method includes mounting a supporting element configured to surround the cable at a predetermined position on the cable. The method further includes attaching covers fixedly engaged with one another to substantially surround the supporting element, the covers being connected to a wing portion of the deflector. The supporting element and the covers are configured so that the wing portion extending away from the predetermined position remains able to rotate about three rectangular axes while being towed underwater.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a marine seismic survey system. However, the embodiments to be discussed next are not limited to a marine seismic survey system, but may be applied to other situations in which cables are towed underwater.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
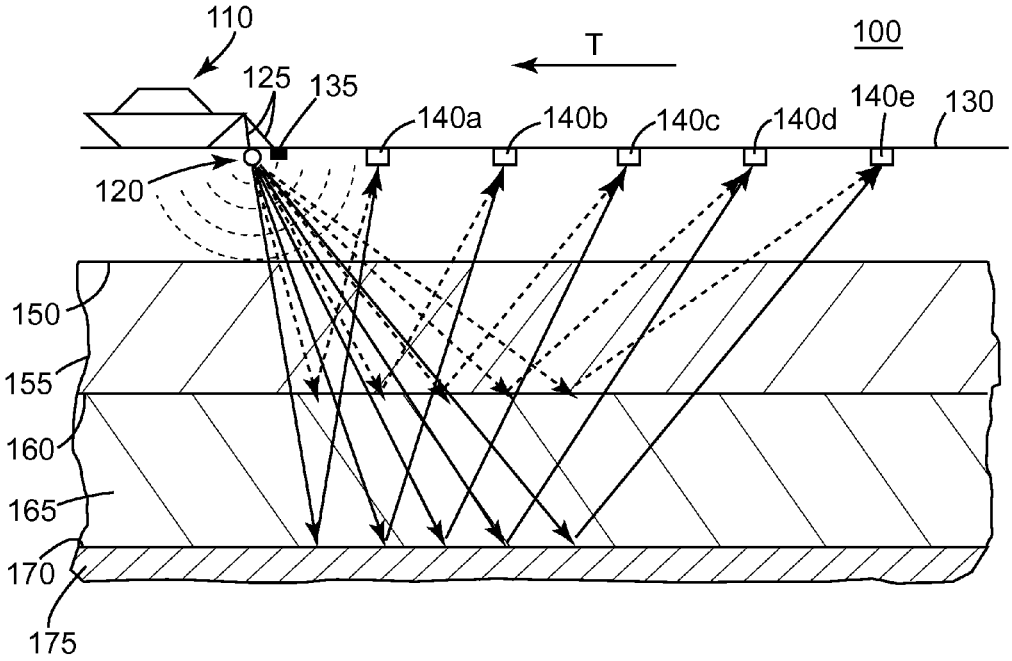
Figure 1 (Background Art)
FIG. 1 is a schematic diagram of a marine survey system.
Figure 2:
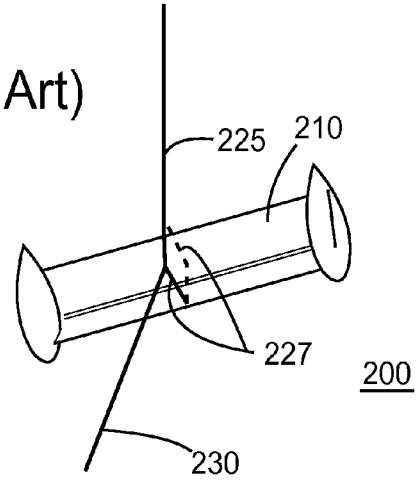
Figure 2 (Background Art)
FIG. 2 illustrates a conventional deflector.
Figure 3:
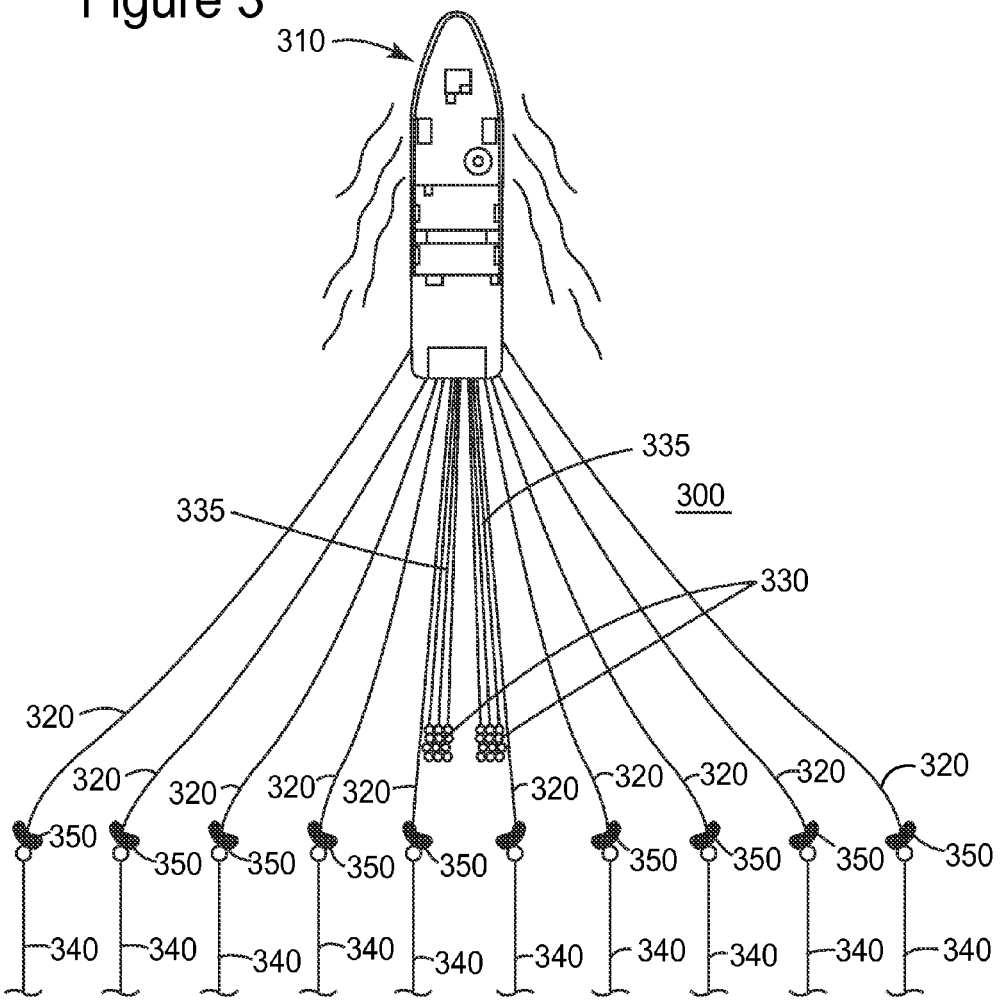
FIG. 3 is a schematic diagram of a marine survey system according to an exemplary embodiment.

FIG. 3 is a schematic diagram of a marine seismic survey system 300 (bird's eye view) according to an exemplary embodiment. The system 300 includes a vessel 310 that tows a spread. The lead-in cables 320 of the spread are configured to be deployed according to a predetermined geometry so that streamers 340 remain substantially parallel at predetermined distances there-between. Hydrophones or other receivers located along the streamers 340 record data related to reflected waves following shots (i.e., when one or more seismic sources 330 generates seismic waves). One or more deflectors may be attached to the lead-in cables 320. FIG. 3 illustrates a deflector 350 attached to each of the lead-in cables 320. However, depending on deflector's size and placement and the presence of separation ropes between the cables, a deflector may have impact on plural streamers. Alternatively, plural deflectors may be mounted along a single cable. Deflectors may also be mounted on the spreads 335 used for towing the seismic sources 330. The number of streamers illustrated in FIG. 3 is exemplary and not intended to be limiting.

Figure 4:
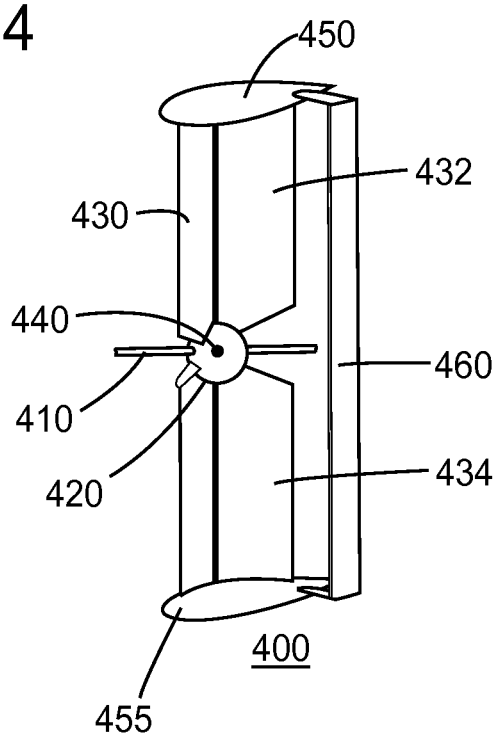
FIG. 4 is a schematic diagram of a deflector according to an exemplary embodiment.

FIG. 4 illustrates a deflector 400 configured to be mounted to a cable 410 towed by a vessel (not shown) according to an exemplary embodiment. The deflector 400 has a body 420 configured to provide a lift force when attached to the cable 410 and towed. The body 420 includes a wing portion 430 and a knuckle portion 440. The wing portion 430 includes substantially flat wings 432 and 434 extending away from the knuckle portion 440. The term "substantially flat" in this context means that the main geometrical characteristic of the wings is having a planar shape, the departure from flatness being merely to smooth edges and transition to connecting elements (i.e. the knuckle portion 440) in order to minimize friction when the deflector 400 is towed through the water.

The knuckle portion 440 is configured to connect the wing portion 430 to the cable 410 so that the wing portion 430 remains able to rotate about three rectangular axes while being towed underwater.

The deflector 400 may include ballast bodies 450 and 455 attached to distal ends of the wing portion 430. The ballast bodies 450 and 455 may have different weights, thereby shifting the center of gravity away from the center of buoyancy to favor the deflector's vertical positioning while in the water because the line between the center of buoyancy and the center of gravity tends to align along gravity.

The deflector 400 may also include a tail 460 that is substantially flat and makes a predetermined angle with the wings 432 and 434 of the wing portion 430. The wings 432 and 434 may be coplanar.

Figure 5:
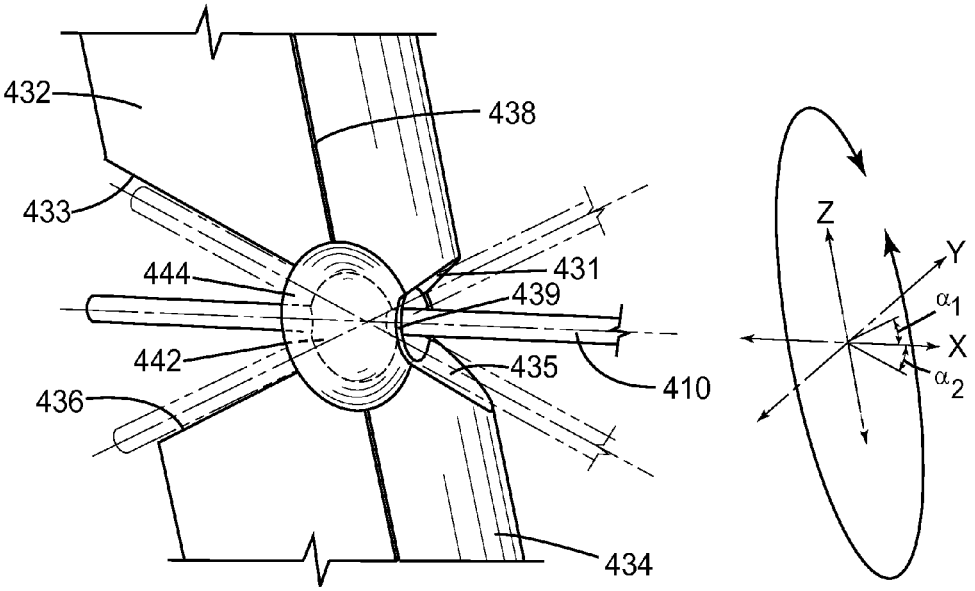
FIG. 5 is a schematic diagram of a deflector according to another exemplary embodiment.

As illustrated in FIG. 5, the knuckle portion 440 may include a supporting element 442 configured to surround the cable 410 and covers 444 and 446 configured to partially surround the supporting element 442. Covers 444 and 446 are illustrated FIG. 7 in a cross-section of the knuckle portion 440 along the tow direction T. The supporting element 442 and the covers may be configured to allow water to enter there-between. The supporting element 442 and the covers may be made of metal, composite or plastic. In some embodiments, the supporting element 442 may be covered by grease.

The covers are configured so that the wing portion 430 attached to the covers may freely rotate about the three rectangular axes x, y, z where x may coincide with the travel direction. While the wing portion may rotate at any angle around the travel direction x, the rotation around axis y may be within a first limited range (e.g., $\pm\alpha_1$ in the plane formed by axes x and z), and the rotation around axis z may be within a second limited range (e.g., $\pm\alpha_2$ in the plane formed by axes x and y). Note that the first and the second ranges may not be symmetric relative to x axis and may be different from one another.

In FIG. 5, the wing 432 and the wing 434 are attached to covers. The wings 432 and 434 may have similar shapes, and they may also have a slot 438 along the wings, configured to lower tension on the wings while towed through water. In one embodiment illustrated in FIG. 6 (viewed perpendicular to the cable 410), both wings 432 and 434 of the wing portion are attached to a cover 544. That is, the cover 544 may form a single piece with the wing portion. However, in another embodiment, each of the wings may be attached to one cover, the covers being fixedly engaged with one another when the deflector is mounted on the cable 410 to be deployed.

Figure 6:
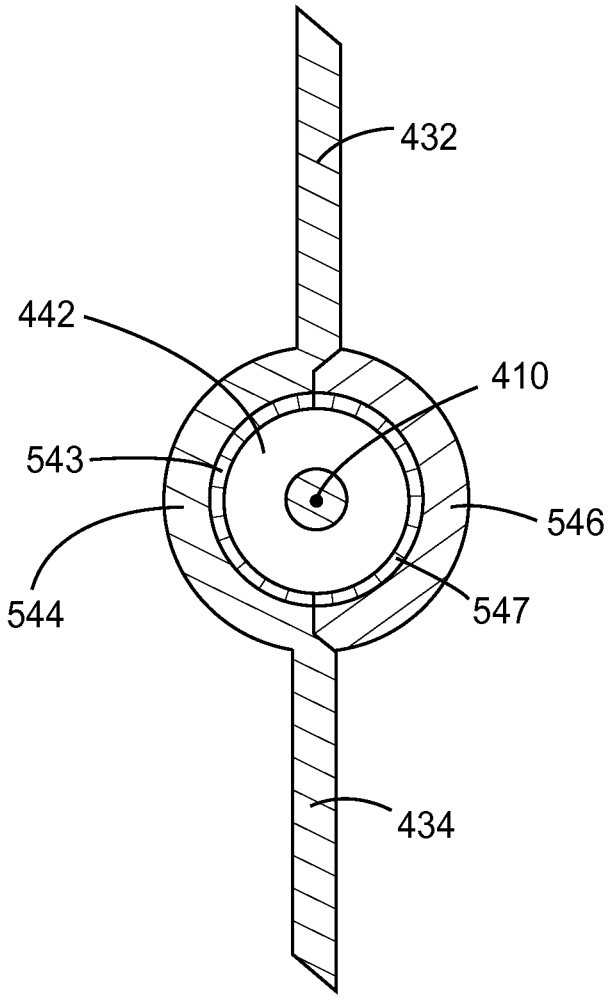
FIG. 6 is a schematic diagram of a deflector according to still another exemplary embodiment.

The covers may be configured to have opening (one opening 439 is visible in FIG. 5) around the travel direction, i.e., x-direction in FIG. 5, to allow the wings 432 and 434 to rotate within the limited ranges. The surface of each opening facing axes X may correspond to an outer surface of a truncated cone. In FIG. 6, surface 543 of cover 544 and surface 547 of cover 546 may form an outer surface of a truncated cone surface (having the appearance of a ring in this view) corresponding to one of the openings.

These openings may be configured to allow the wing portion to rotate up to 20° around axes (e.g., y and z) perpendicular to the travel direction (x). The ranges $\pm\alpha_1$ and $\pm\alpha_2$ may be different, e.g., one may be up to 20°, and other may be up to 15°.

The shape of the wings 432 and 434 may be substantially rectangular. However, the wings 432 and 434 may narrow toward the cover openings, so that edge surfaces 431, 433, 435 and 436 of the wings 432 and 434 have a slope matching the slope of the openings, thereby the edge surfaces acting as additional barriers limiting the wing rotations. FIG. 5 shows how the deflector 400 can rotate about axis Y until edge surfaces 431 and 435 contact the cable 410.

Figure 7:
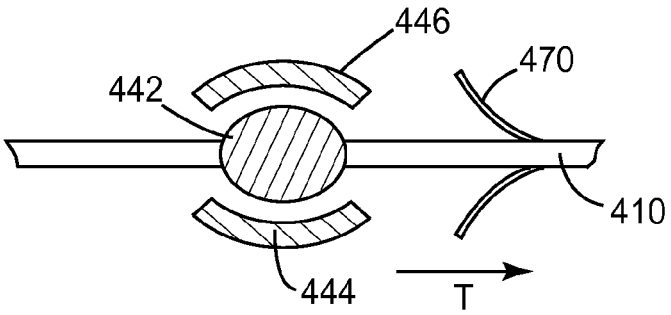
FIG. 7 is a schematic diagram of a deflector according to yet another exemplary embodiment.

In an embodiment illustrated in FIG. 7, a deflecting surface 470 may be positioned on the cable 410 ahead (considering the travel direction T) of the supporting element 442. The deflecting surface 470 is configured to deflect water flow directed toward a volume between the supporting element 442 and the covers 444 and 446 while the deflector is towed underwater. The deflecting surface 470 may be attached to the cable 410.

Figure 8:
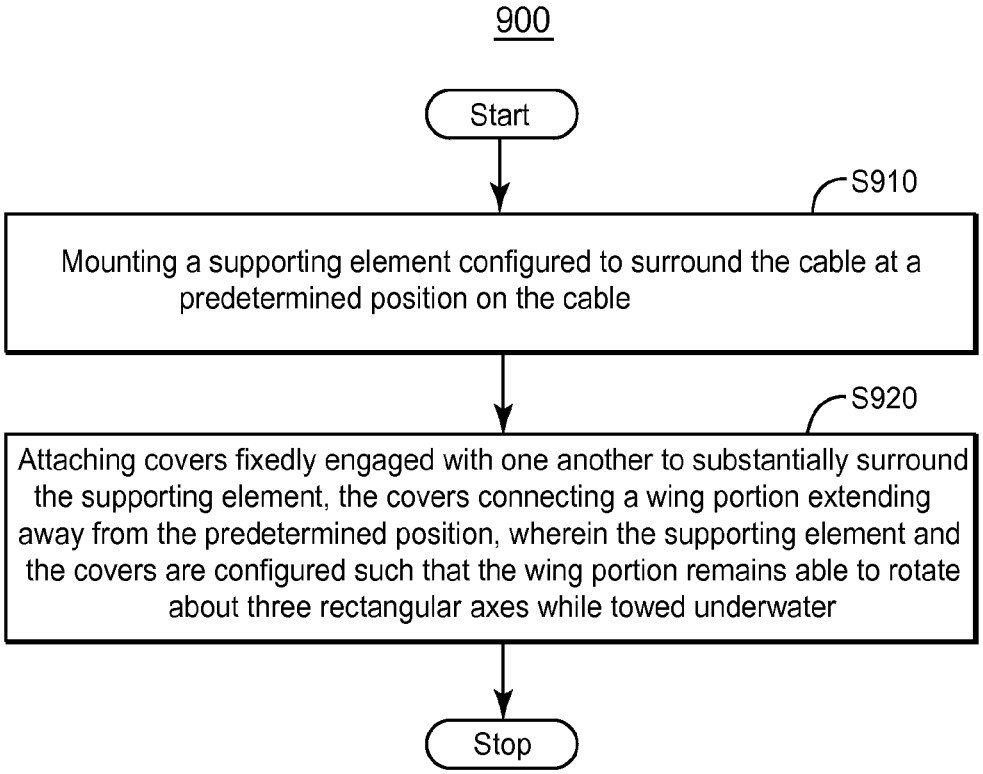
FIG. 8 is a flow chart of a method of placing a deflector on a cable towed by a vessel of a marine survey system, according to an exemplary embodiment.

FIG. 8 illustrates a flow chart of a method 900 of placing a deflector on a cable towed by a vessel of a marine seismic survey system according to another exemplary embodiment. The method 900 includes mounting a supporting element configured to surround the cable at a predetermined position on the cable, at S910. The method 900 further includes attaching covers fixedly engaged with one another to substantially surround the supporting element, with the covers connecting a wing portion extending away from the predetermined position, at S920. The supporting element and the covers are configured so that the wing portion remains able to rotate about three rectangular axes while being towed underwater.

One or more of the exemplary embodiments discussed above are related to deflectors attached to a towing cable of a vessel towing a marine data acquisition system. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A deflector configured to be attached to a cable towed by a vessel, the deflector comprising:

a body configured to provide a lift force to the cable and including a wing portion that has substantially flat wings extending away from a position where the body is attached to the cable, and a knuckle portion configured to attach the wing portion to the cable so that the wing portion remains able to rotate about three rectangular axes while being towed underwater, one of the three rectangular axes being along a traveling direction, wherein the knuckle portion includes a supporting element configured to surround the cable at the position where the body is attached to the cable, and covers configured to partially surround the supporting element and having openings around a travel direction, the openings being configured to allow the wing portion attached to the covers to rotate within predetermined angular ranges, about two axes among the three rectangular axes, the two axes being perpendicular to the travelling direction.

2. The deflector of claim 1, wherein the supporting element and the covers are configured to allow water to enter therebetween.

3. The deflector of claim 1, wherein the openings are configured to allow the wing portion to rotate up to 20° about the two axes perpendicular to the travel direction.

4. The deflector of claim 1, wherein a surface of each of the openings has a shape of an outer surface of a truncated cone.

5. The deflector of claim 4, wherein the wings have a rectangular shape for most of their length and narrow toward the position where the body is attached to the cable, such that edges of the wings have a slope matching a slope of the truncated cone.

6. The deflector of claim 1, wherein the covers are fixedly engaged with one another.

7. The deflector of claim 1, wherein the supporting element and the covers are made of metal, composite or plastic.

8. The deflector of claim 1, wherein the supporting element is covered by grease.

9. The deflector of claim 1, further comprising:

a deflecting surface positioned on the cable ahead of the supporting element in the towing direction and configured to deflect a water flow directed toward a volume between the supporting element and the covers while the deflector is towed underwater.

10. The deflector of claim 1, wherein one of the covers is formed as a single piece with the wing portion.

11. The deflector of claim 1, further comprising:

ballast bodies attached to distal ends of the wing portion relative to the position where the body is attached to the cable, the ballast bodies having different weights.

12. The deflector of claim 1, wherein the wings are substantially coplanar and the deflector further comprises a tail that is substantially flat and makes a predetermined angle with the wings.

13. A marine seismic survey system, comprising:

a cable towed by a vessel; and a deflector attached to the cable and including (A) a wing portion having substantially flat wings extending away from a position where the deflector is attached to the cable, and (B) a knuckle portion configured to attach the wing portion to the cable so that the wing portion remains able to rotate about three rectangular axes while being towed underwater, one of the three rectangular axes being along a traveling direction, wherein the knuckle portion includes a supporting element configured to surround the cable, and covers configured to partially surround the supporting element and having openings around a travel direction, the openings being configured to allow the wing portion attached to the covers to rotate within predetermined angular ranges, about two axes among the three rectangular axes, the two axes being perpendicular to the travelling direction.

14. The marine seismic survey system of claim 13, wherein a surface of each opening toward the travel direction corresponds to an outer surface of a truncated cone such that the wing portion to be able to rotate up to 20° about the two axes perpendicular to the travel direction.

15. The marine seismic survey system of claim 14, wherein the wings are partially rectangular and narrow toward the position where the deflector is attached to the cable, such that edges of the wings to have a slope matching a slope of the truncated cone.

16. The marine seismic survey system of claim 13, wherein the supporting element is covered with grease and the deflector further comprises a deflecting surface configured to deflect a water flow directed toward a volume between the supporting element and the covers.

17. A method of placing a deflector on a cable towed by a vessel of a marine survey system, the method comprising:

mounting a supporting element configured to surround the cable at a predetermined position on the cable; and attaching covers fixedly engaged with one another to substantially surround the supporting element, the covers being connected to a wing portion extending away from the predetermined position, wherein the covers are configured so that the wing portion remains able to rotate about three rectangular axes while being towed underwater, one of the three rectangular axes being along a traveling direction, the wing portion being able to rotate within predetermined angular ranges about two axes among the three rectangular axes, the two axes being perpendicular to the travelling direction.

18. The method of claim 17, further comprising:

attaching a deflecting surface on the cable ahead of the supporting element in the towing direction, the deflecting surface being configured to deflect a water flow directed toward a volume between the supporting element and the covers while the deflector is towed underwater.

* * * * *